US010531753B1

(12) United States Patent
Cleveland et al.

(10) Patent No.: US 10,531,753 B1
(45) Date of Patent: Jan. 14, 2020

(54) BEVERAGE CAN HOLDING APPARATUS

(71) Applicants: Kevin Cleveland, Fairmont, WV (US); Sarah Cleveland, Fairmont, WV (US)

(72) Inventors: Kevin Cleveland, Fairmont, WV (US); Sarah Cleveland, Fairmont, WV (US)

( * ) Notice: Subject to any disclaimer, the term of this patent is extended or adjusted under 35 U.S.C. 154(b) by 0 days.

(21) Appl. No.: 16/262,181

(22) Filed: Jan. 30, 2019

(51) Int. Cl.
*A47G 19/22* (2006.01)
*B65D 51/24* (2006.01)

(52) U.S. Cl.
CPC ..... *A47G 19/2272* (2013.01); *A47G 19/2255* (2013.01); *B65D 51/242* (2013.01); *B65D 51/245* (2013.01)

(58) Field of Classification Search
CPC ..... A47G 19/2272; A47G 19/2255; B65D 51/245; B65D 51/242
USPC ..... 220/740, 212.5, 254.3, 710.5, 715
See application file for complete search history.

(56) References Cited

U.S. PATENT DOCUMENTS 3,107,029 A * 10/1963 Rylander ..... A47G 23/0266 215/396
3,719,305 A * 3/1973 Pressnell ..... A47G 23/0233 215/395
4,494,672 A * 1/1985 Pearson ..... B65D 47/088 220/258.2
4,555,034 A * 11/1985 Gerhards ..... A47G 19/2205 215/235
5,199,597 A * 4/1993 Gladish ..... A47G 19/12 220/254.9
6,637,618 B2 * 10/2003 Friederich ..... A47G 19/2205 220/845
2008/0047962 A1 2/2008 Salvador
2018/0153285 A1 6/2018 Tanaka

* cited by examiner

*Primary Examiner* — James N Smalley
(74) *Attorney, Agent, or Firm* — Dale J. Ream

(57) ABSTRACT

A beverage can holding apparatus for holding a beverage can includes a cam lever having a hook end engaging a pull tab and a clamping end defining a bore. A pin is positioned in the bore for pivotal movement of the cam lever thereabout. A cam handle member includes an actuator end coupled to the pin and an opposing finger ring, the actuator end having an irregular shape having narrow and expanded portions acting as a cam. A clamp is coupled to the cam handle member for engaging an outer surface of the lip of the beverage can. The cam handle member is a cam that selectively locks the cam lever onto the beverage can. A cover assembly is removably coupled to the cam lever, the cover base having a lip portion operable for engaging the lip of the beverage can and covering the drink opening of the beverage can.

20 Claims, 12 Drawing Sheets

BEVERAGE CAN HOLDING APPARATUS

BACKGROUND OF THE INVENTION

This invention relates generally to article holding devices and, more particularly, to a beverage can holding apparatus that uses a cam action to lock onto a beverage can more securely and that has an identification window for preventing confusion over whose beverage can is being carried.

Multiple beverage cans get opened during a party, a family gathering, or other similar social setting and the cans tend to be placed on a countertop, end table, or other locations as it may become difficult or undesirable for a person to carry his drink around. Understandably, it becomes difficult or impossible for the person who opened a beverage can to later know for sure he is picking up the can he opened. For sanitary and health reasons, there is a desire for a consumer to identify the beverage can he opened before drinking from it. But with cans, there is no easy way to write a name on the can in the manner typical with paper or plastic cups.

Various devices have been proposed in the prior patents for holding a beverage can. Although presumably effective for their intended purposes, the existing proposals are inadequate for locking onto a beverage can, for securely holding the can, or for identifying the consumer associated with the beverage can.

Therefore, it would be desirable to have a beverage can holding apparatus having a cam locking lever attachment that enables a user to lock the apparatus onto the top lip of a beverage can in a manner that is secure for carrying the can. Further, it would be desirable to have a beverage can holding apparatus having a finger ring by which a consumer may carry the beverage can once the cam apparatus is locked on. In addition, it would be desirable to have a beverage can holding apparatus having an identification reservoir that enables a consumer to personalize and identify his beverage can.

SUMMARY OF THE INVENTION

A beverage can holding apparatus for assisting a person holding a beverage can according to the present invention includes a cam lever having a hook end operable for engaging the pull tab and a clamping end opposite the hook end, the clamping end defining a bore. A pin is positioned in the bore and defines an axis of rotation for pivotal movement of the cam lever. A cam handle member includes an actuator end rotatably coupled to the pin and a ring opposite the actuator end, the actuator end having an irregular shape that includes a narrow portion having a first radius relative to the pin and an expanded portion having a second radius relative to the pin and larger than the first radius. A clamp is operably coupled to the cam handle member via a linkage and having an inner surface operable to engage an outer surface of the lip of the beverage can when actuated.

The cam handle member is rotatably movable about the pin between a stowed configuration in which the expanded portion of actuator end is displaced from the clamp and a deployed configuration at which the expanded portion of the actuator member bears against and urges the clamp to engage an outside surface of the lip of the beverage can. A cover assembly that includes a cover base is removably coupled to the cam lever, the cover base having a lip portion operable for engaging the lip of the beverage can and covering the drink opening of the beverage can.

Therefore, a general object of this invention is to provide a beverage can holding apparatus for holding a beverage can securely so that it may be picked up and carried easily, even when full.

Another object of this invention is to provide a beverage can holding apparatus, as aforesaid, having a cam locking device that may be deployed by the person intending to carry the beverage can.

Still another object of this invention is to provide a beverage can holding apparatus, as aforesaid, having a cover assembly that covers the drink opening of the beverage can until the user intentionally prepare to take a drink.

Yet another object of this invention is to provide a beverage can holding apparatus, as aforesaid, having an identification reservoir that enables a person to personalize or identify a beverage can as being the one he opened.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
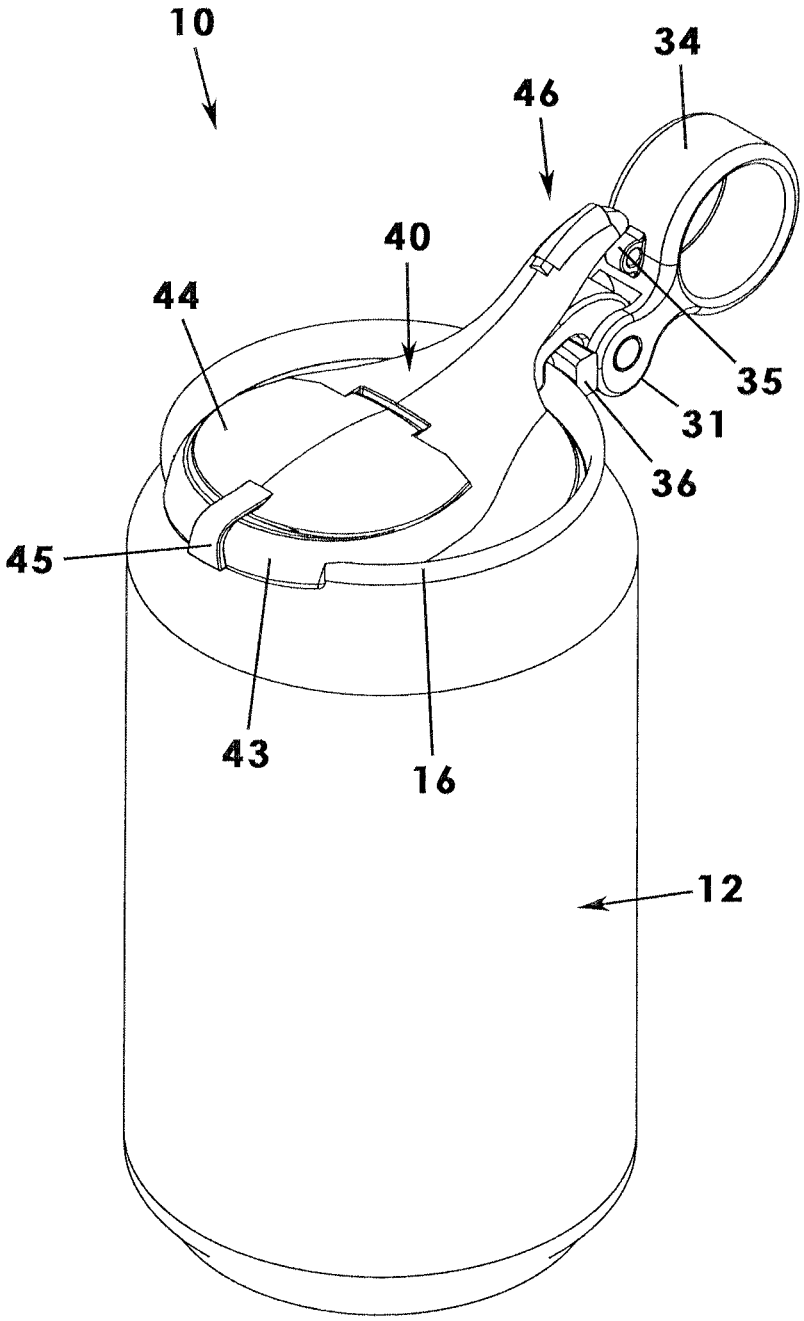
FIG. 1 is a front perspective view of a beverage can holding apparatus according to a preferred embodiment of the present invention, illustrated in use attached to a beverage can.
Figure 2:
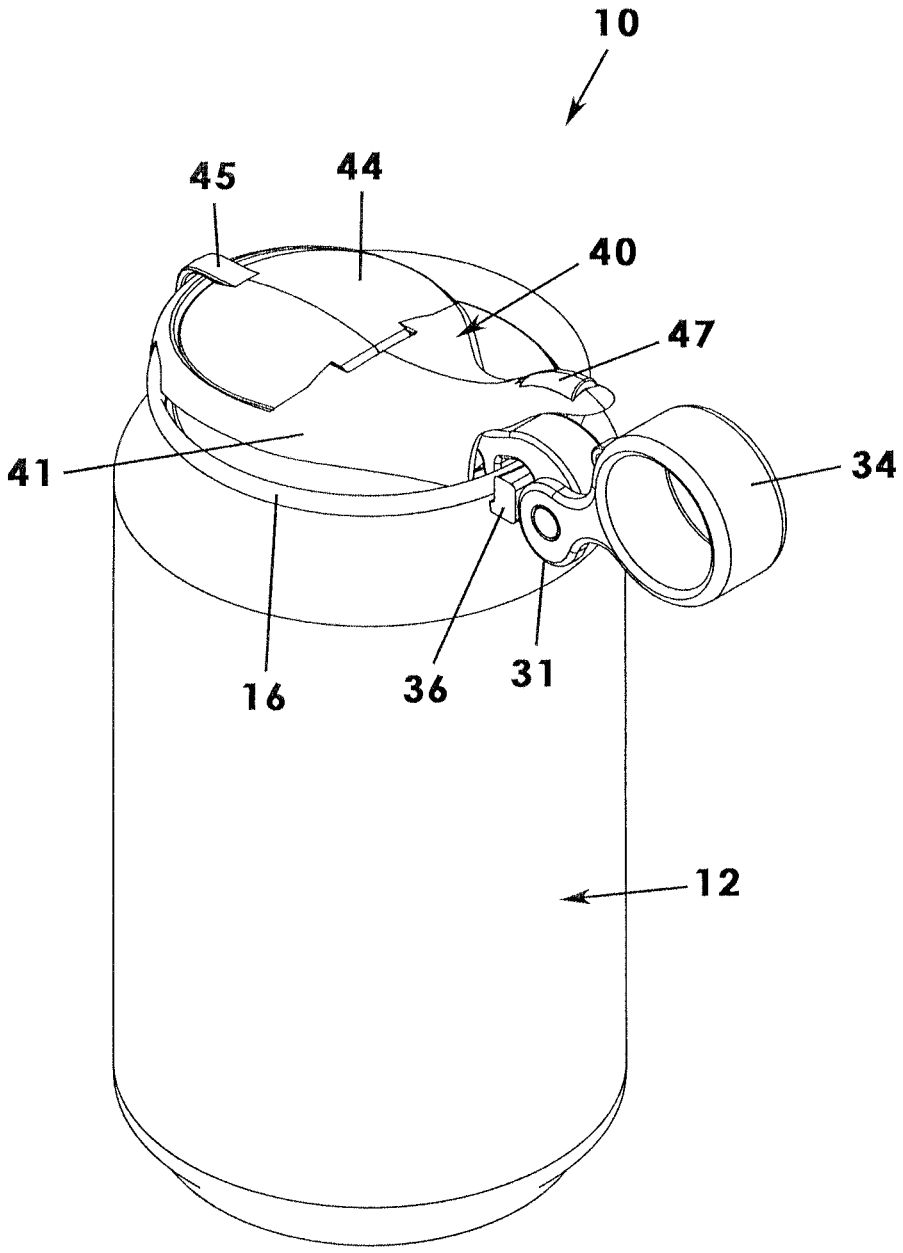
FIG. 2 is a rear perspective view of the holding apparatus as in FIG. 1.
Figure 3:
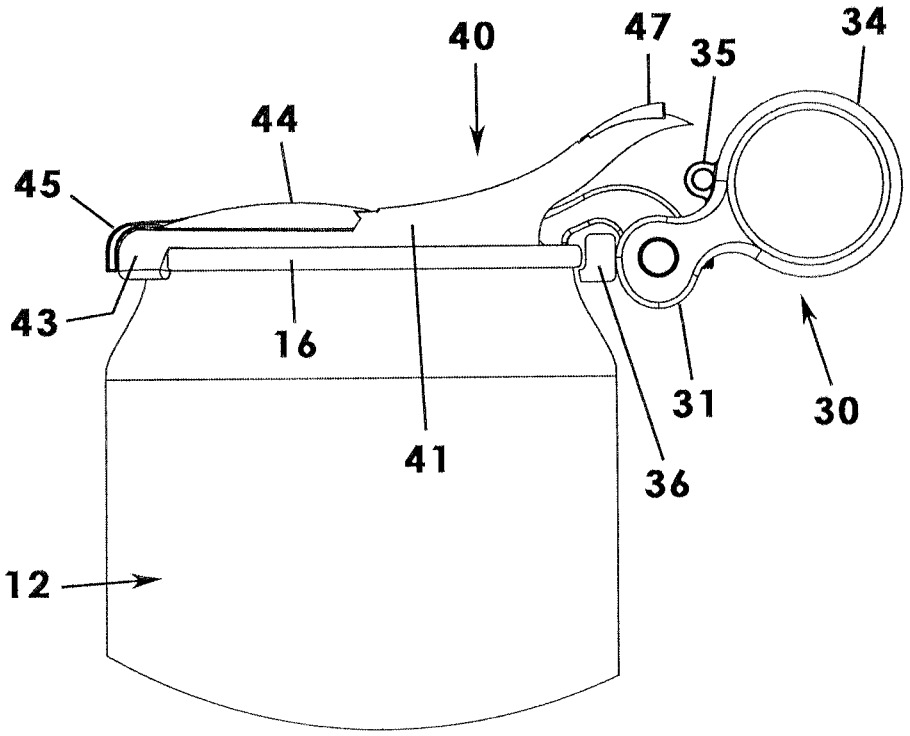
FIG. 3 is a fragmentary side view of the holding apparatus as in FIG. 1, illustrated with a cam handle in a stowed configuration.

A beverage can holding apparatus according to a preferred embodiment of the present invention will now be described in detail with reference to FIGS. 1 to 13 of the accompanying drawings. The beverage can holding apparatus 10 includes a cam lever 20, a cam handle 30, a clamp 36, and a cover assembly 40. It is understood that the beverage can holding apparatus 10 is intended for assisting a user in holding or carrying a beverage can 12 of the type having a pull tab 14 for opening the can 12, a lip 16 around the top of the can, and which defines a drink opening 18.

The cam lever 20 has a generally linear configuration defining an imaginary longitudinal axis and has a hook end 21 and a clamping end 22 opposite the hook end 21. Preferably, the clamping end 22 has a generally rounded shape (FIG. 13) although other configurations may also work. The clamping end 22 defines a bore 23 between respective side walls thereof, the bore 23 being perpendicular to the longitudinal axis of the cam lever 20. A pin 24 may be positioned in the bore 23 and to which an end of the cam handle 30 may be attached for rotatable movement thereof as will be described in more detail later. The pin 24 also defines a threaded throughbore 24*a* perpendicular to the bore 23 and being aligned with and configured to receive the guide pin 38 described later.

The hook end 21 includes a free end in the shape of a downwardly oriented hook or flange that is operable and configured to engage the pull tab 14 of the beverage can 12, it being understood that the pull tab 14 is the mechanism on a traditional beverage can 12 that penetrates a perforated top of the can and opens the drink opening 18 thereof. The hook end 21 is positioned to grasp the pull tab 14 and provides the stable leverage needed to attach or lock the cam lever 20 to the lip 16 of the can 12 as will become apparent in view of the following description. The clamping end 22 of the cam lever 20 may also define a longitudinal bore 25 extending completely therethrough, the longitudinal bore 25 being in communication with and perpendicular to the bore 23 extending between lateral sides of the clamping end 22 and described previously. The longitudinal bore 25 is aligned with or parallel to the imaginary longitudinal axis of the cam lever 20 and is a component of the linkage that facilitates locking the cam lever 20 onto a can 12.

Figure 9:
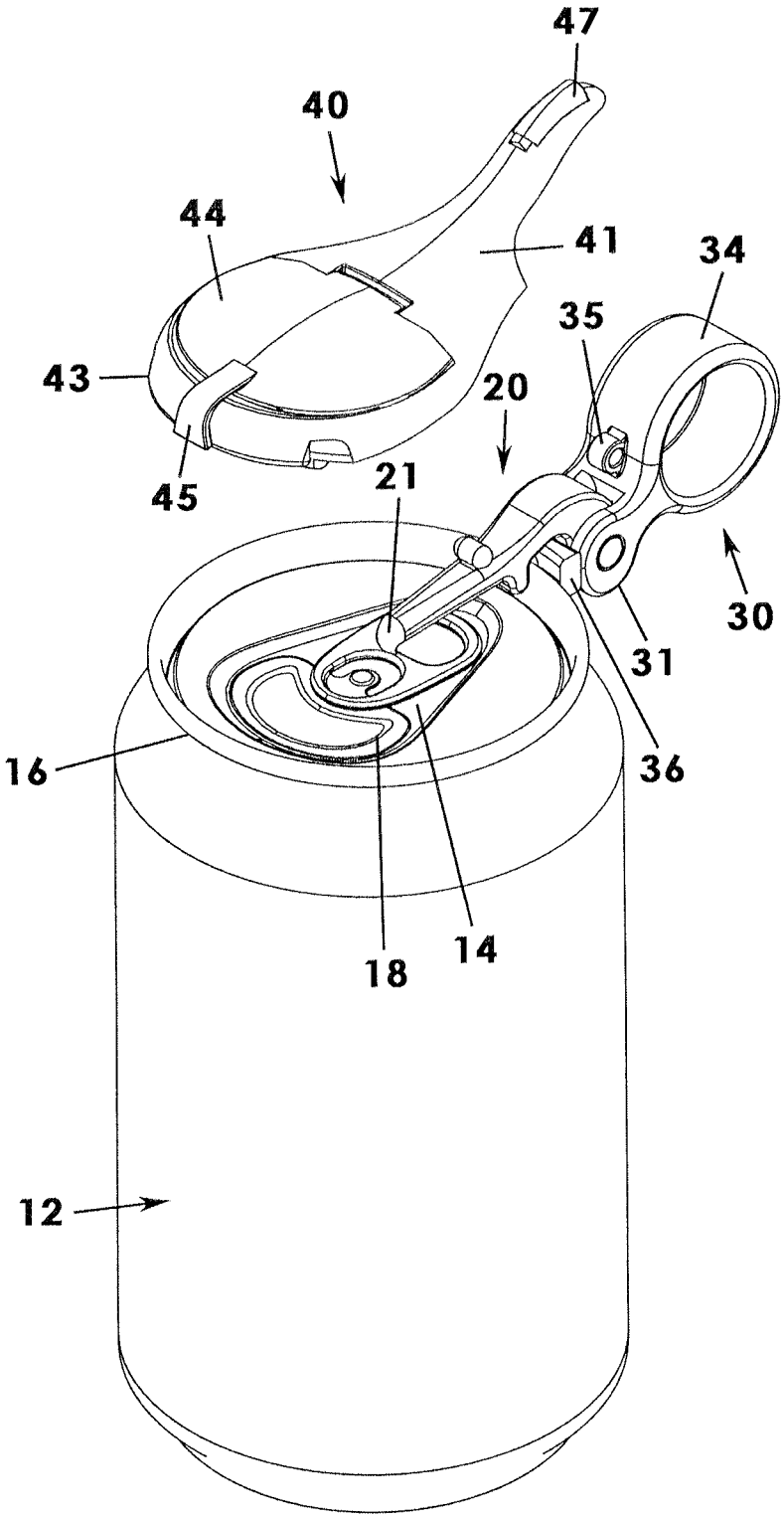
FIG. 9 is a perspective view of the holding apparatus with the cover assembly removed from the cam lever.
Figure 11:
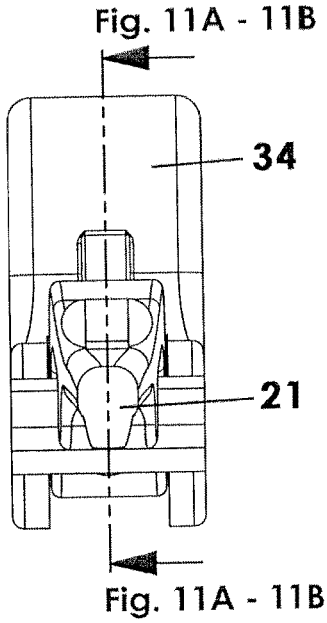
FIG. 11 is a front view is a front view of a cam lever and cam handle removed from a remainder of the holding apparatus according to the present invention.

Further, the cam lever 20 includes a lip flange 26 that is situated intermediate the hook end 21 and clamping end 22. More particularly, the lip flange 26 extends downwardly from a body of the cam lever 20 and may have a unitary construction with the cam lever 20. The lip flange 26 has a shape configuration and is positioned so as to selectively engage an inner surface of the lip 16 of the beverage can 12 as shown in FIG. 9. The lip flange 26 has a generally flat rearward surface (FIG. 11A) that bears against the inner surface of the lip 16 of the can 12 when the cam lever 20 is locked thereto. In fact, the inner surface of the lip flange 26 and the clamp 36 (described later) sandwich the lip 16 of the can 12 and tighten thereabout when the cam handle 30 is actuated as will be described below.

Figure 11A:
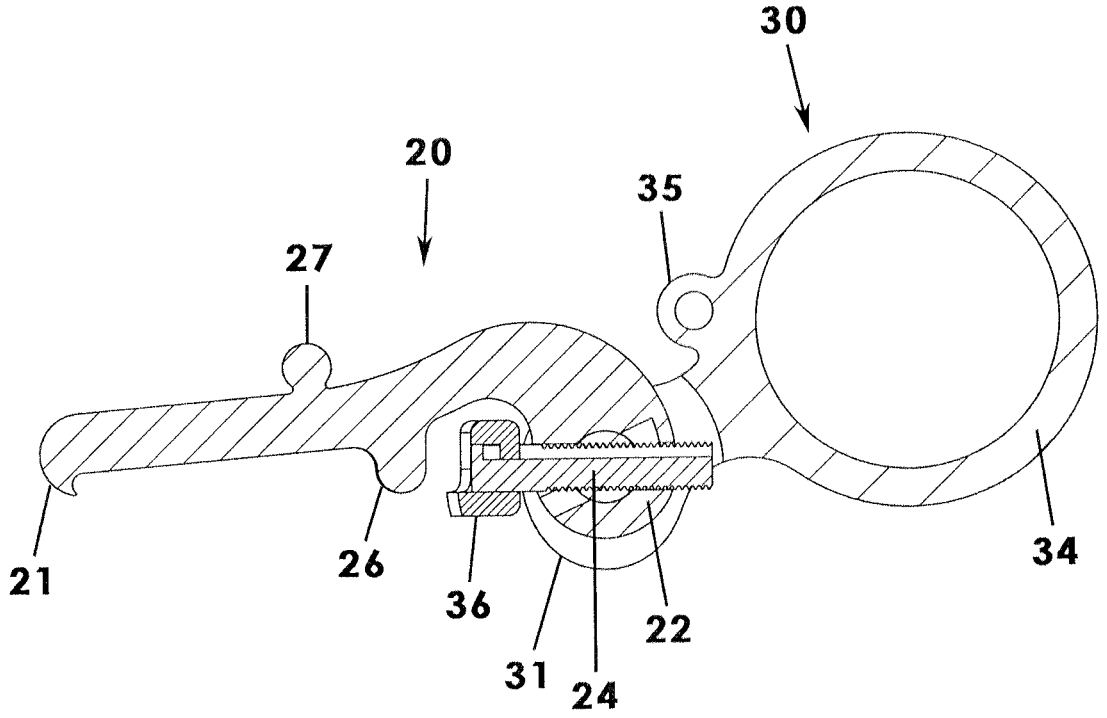
FIG. 11A is a sectional view taken along line 11A-11A of FIG. 11.
Figure 11B:
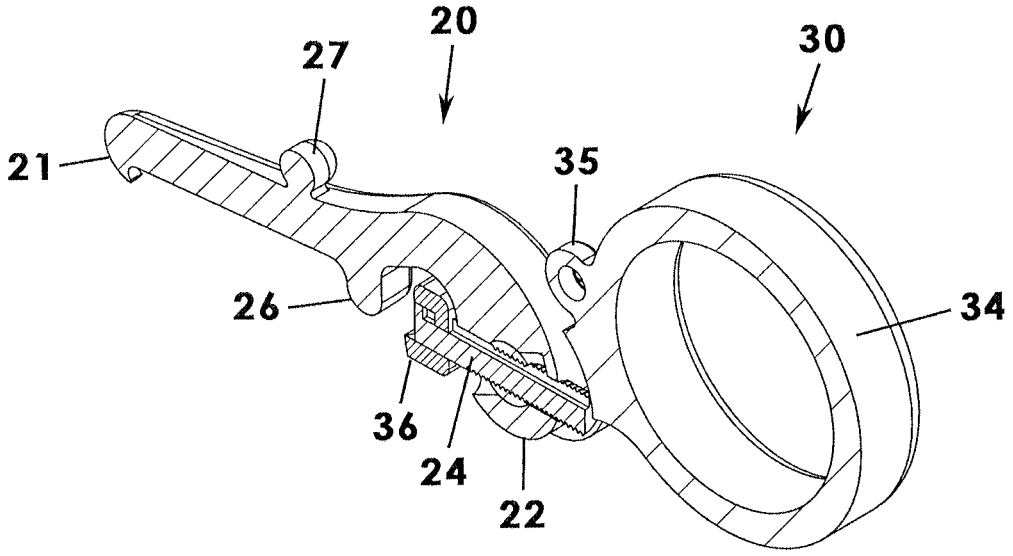
FIG. 11B is a sectional view from another angle taken along line 11B-11B of FIG. 11.
Figure 12:
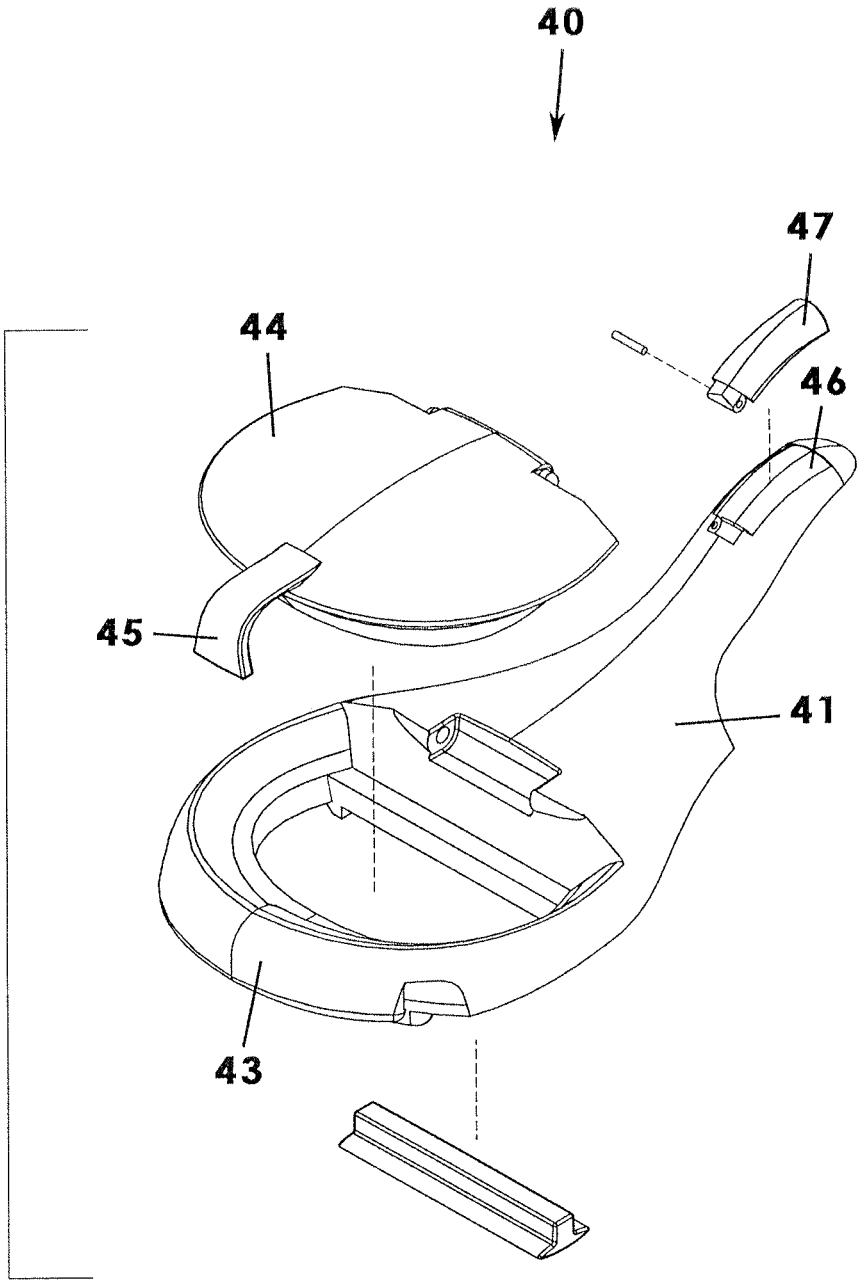
FIG. 12 is an exploded view of the cover assembly as shown in FIG. 9.

As best seen in FIGS. 11A and 11B, the cam lever 20 may also include a mounting knob 27 situated along a top side of the cam lever 20, the mounting knob 27 extending upwardly and having a configuration that is operable to mate with a complementary recess in a bottom of the cover base 41 of the cover assembly 40 described later. This is the means by which the cover assembly 40 is mounted or coupled to the cam lever 20.

Next, a cam handle 30 is coupled to the cam lever 20 and is operable either to lock the cam lever 20 to the top of the beverage can 12 or to release the cam lever 20 as will now be explained in detail. The cam handle 30 may include an actuator end 31 and a ring 34 opposed to the actuator end 31. It is understood, however, that the cam handle 30 may have a unitary construction and may be constructed as a molded or fabricated component. The actuator end 31 may include a pair of forks that are laterally spaced apart from one another and coupled to the pin 24 described above. More particularly, the forks of the actuator end 31 sandwich the lateral sides of the clamping end 22 of the cam lever 20 and the pin 24 extends though the bore 23 of the clamping end 22 and though complementary apertures in respective forks so as to facilitate the movements described herein. For instance the forks of the actuator end 31 may be coupled to the pin 24 in a friction fit relationship but that allows the cam handle 30 to be rotated by gentle urging pressure on the ring 34. The forks of the actuator end 31 essentially define a notch configured to receive the clamping end 22 of the cam lever 20.

Figure 4:
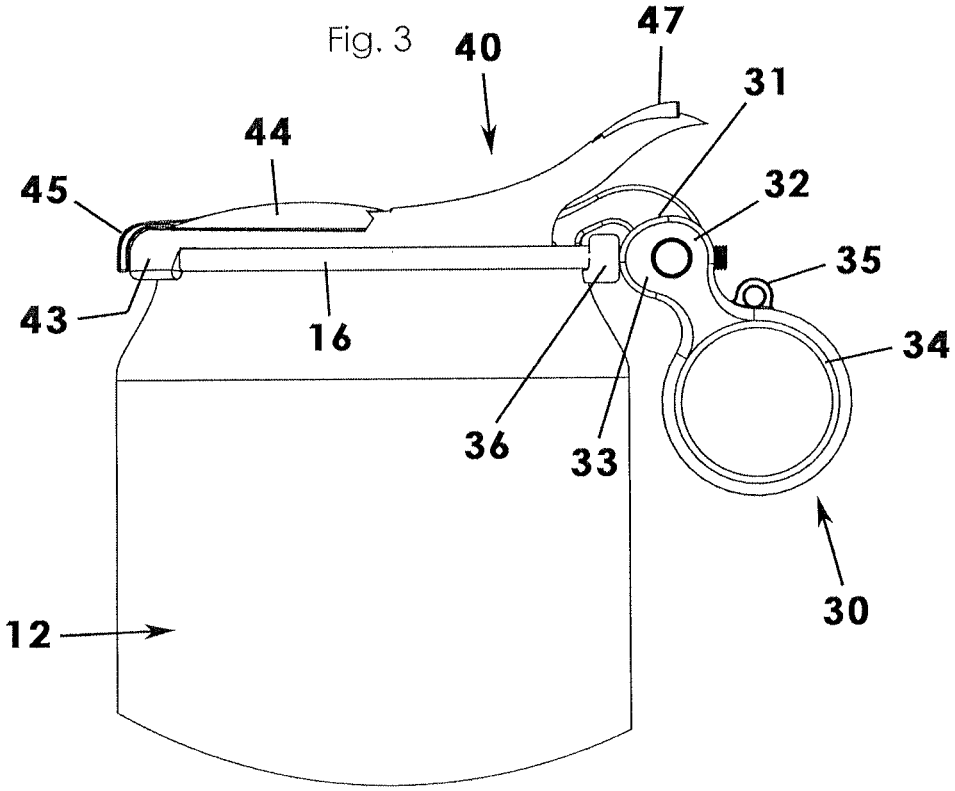
FIG. 4 is a fragmentary side view of the holding apparatus as in FIG. 1, illustrated with the cam handle in a deployed configuration.
Figure 5:
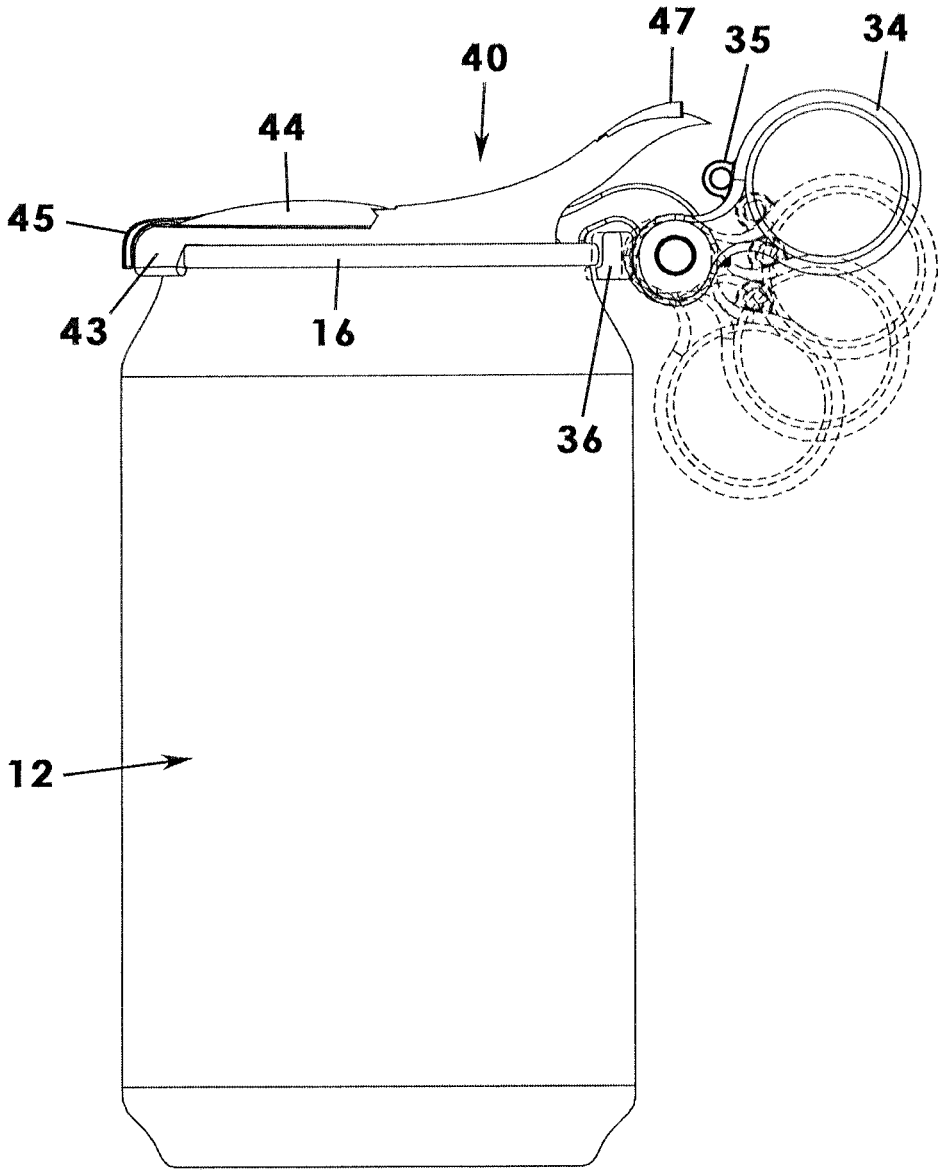
FIG. 5 is a side view of the holding apparatus as in FIG. 1, illustrating the cam handle moving between the stowed and deployed configurations.
Figure 6:
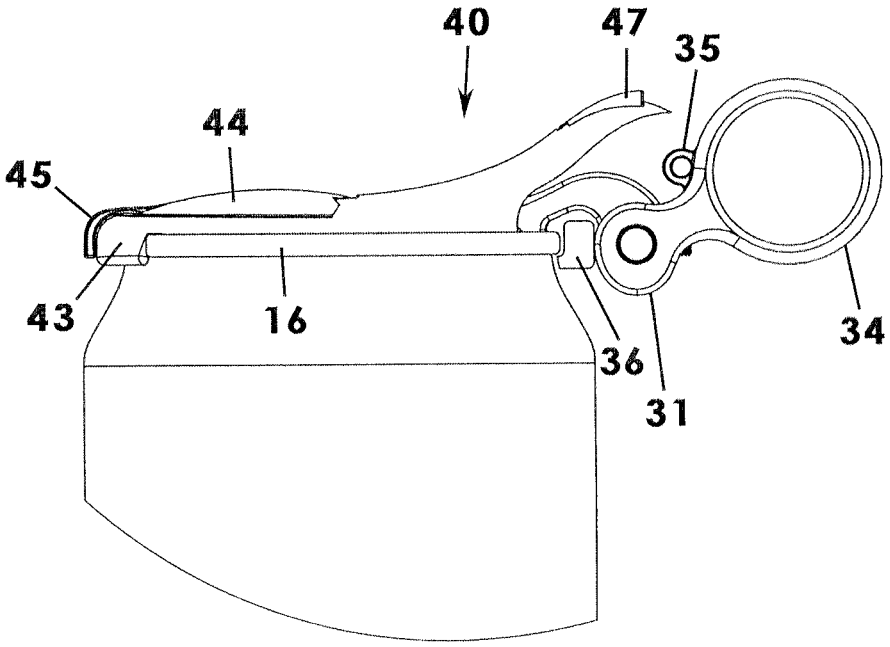
FIG. 6 is a side view of the holding apparatus as in FIG. 3, illustrated with the lid and reservoir cover of a cover assembly in closed configurations, respectively.

With specific reference to the actuator end 31 of the cam handle 30, each fork includes a narrow portion 32 (which may alternatively be referred to as a narrow radius portion) and an expanded portion 33 (which may alternatively be referred to as an enlarged radius portion)—each referring to a geographic area extending away from a respective fork aperture. Stated another way, the forks have a non-symmetrical curvature with each portion having a different radius so as to be useful as a cam when rotated between locked and released configurations. As will be described later, a rotatable movement of the cam handle 30 results either in the narrow portion 32 being displaced from the clamp 36 (the "stowed configuration" shown in FIG. 3) or in the expanded portion 33 bearing against the clamp 36 (the "deployed" or "locked" configuration shown in FIG. 4). Movement of the cam handle 30 is illustrated in FIG. 5.

In another aspect, the beverage can holding apparatus 10 includes a clamp 36. The clamp 36 has an inner surface having a concave configuration complementary to a configuration of an outside surface of the lip 16 of the beverage can 12. In other words, the inner surface of the clamp 36 is configured to bear against the outside surface of the lip 16 when the clamp 36 is urged toward the can 12 by the expanded portion 33 of the cam handle 30 (FIG. 4). The clamp 36 defines a channel 37 that is open and accessed through the inner surface for receiving an element of the linkage described below, the channel 37 being aligned longitudinally with the longitudinal bore 25 defined by the clamping end 22 of the cam lever 20.

Figure 13:
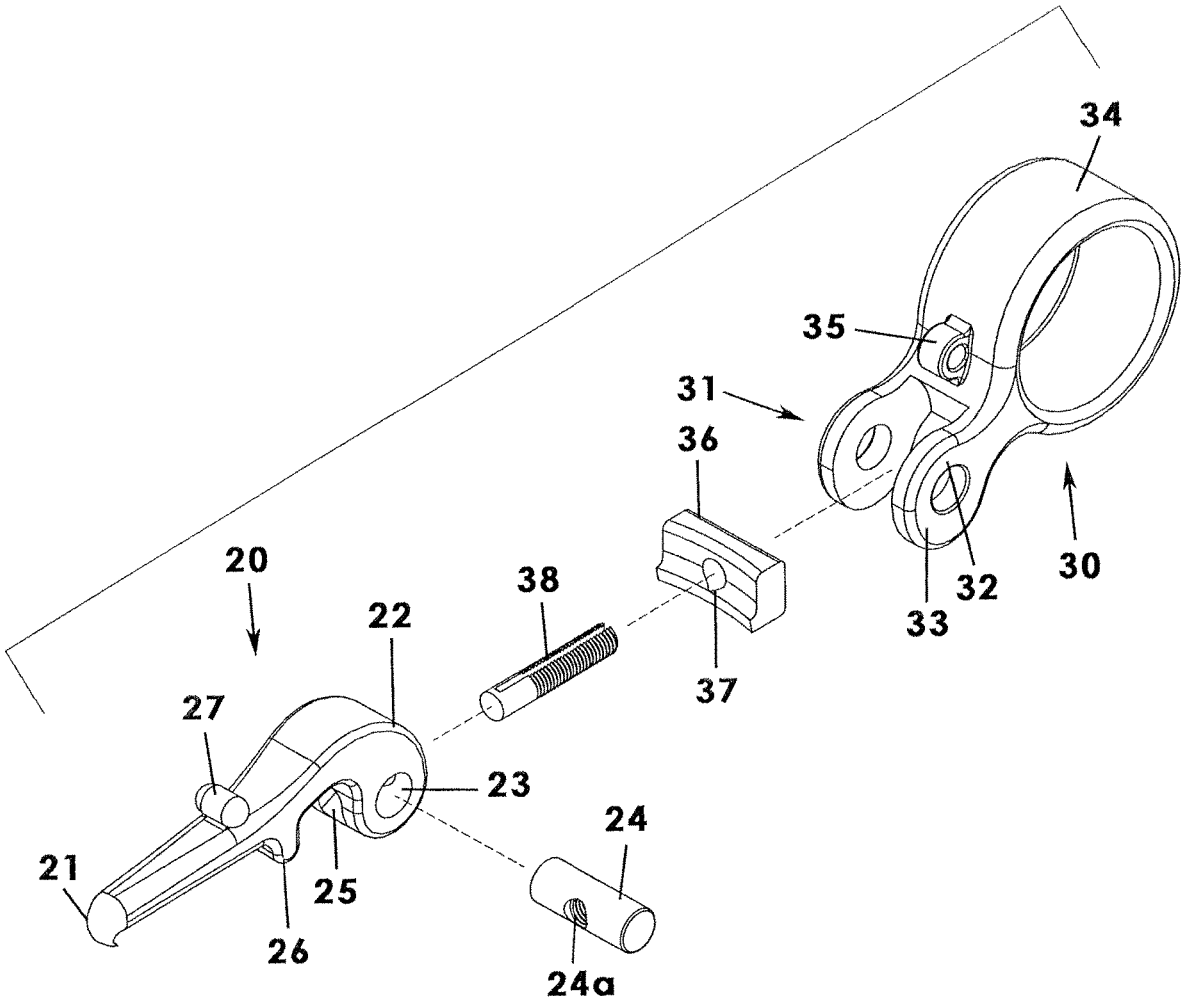
FIG. 13 is an exploded view of the cam lever and cam handle as shown in FIG. 9.

The clamp 36 is positioned intermediate the clamping end 22 and lip flange 26 of the cam lever 20 (FIG. 11A) and is held in position by a linkage. The linkage includes a guide pin 38 that is partially threaded and is dimensioned to pass through the throughbore 24*a* of the pin 24, the longitudinal bore 25 defined by the clamping end 22 of the cam lever 20, and the channel 37 of the clamp 36 (FIG. 13). The guide pin 38 is perpendicular to the pin 24 nested in the bore 23 of the clamping end 22 of the cam lever 20. It will be understood that the threads of the guide pin 38 move threadably in a mating relationship with the threaded configuration of the threaded throughbore 24*a* defined by the pin 24 (FIGS. 11A and 11B). Other complementary gearing may also be employed by the linkage for smooth movement actuated by the cam action of the forks of the actuator end 31 of the cam handle 30.

The ring 34 extends away from the actuator end 31 and includes a continuous side wall that defines a circular aperture and void operable to receive a finger of a user of the apparatus. Accordingly, a person is able to manipulate the cam handle 30 between the stowed and locked configurations with his finger inserted in the ring 34.

In addition, a keychain ring 35 is coupled to the ring 34 of the cam handle 30. It is understood that the keychain ring 35 may also be coupled to a top surface of the cam lever 20. The keychain ring 35 has a circular configuration defining an aperture through which the ring of a key ring may be inserted.

Figure 7:
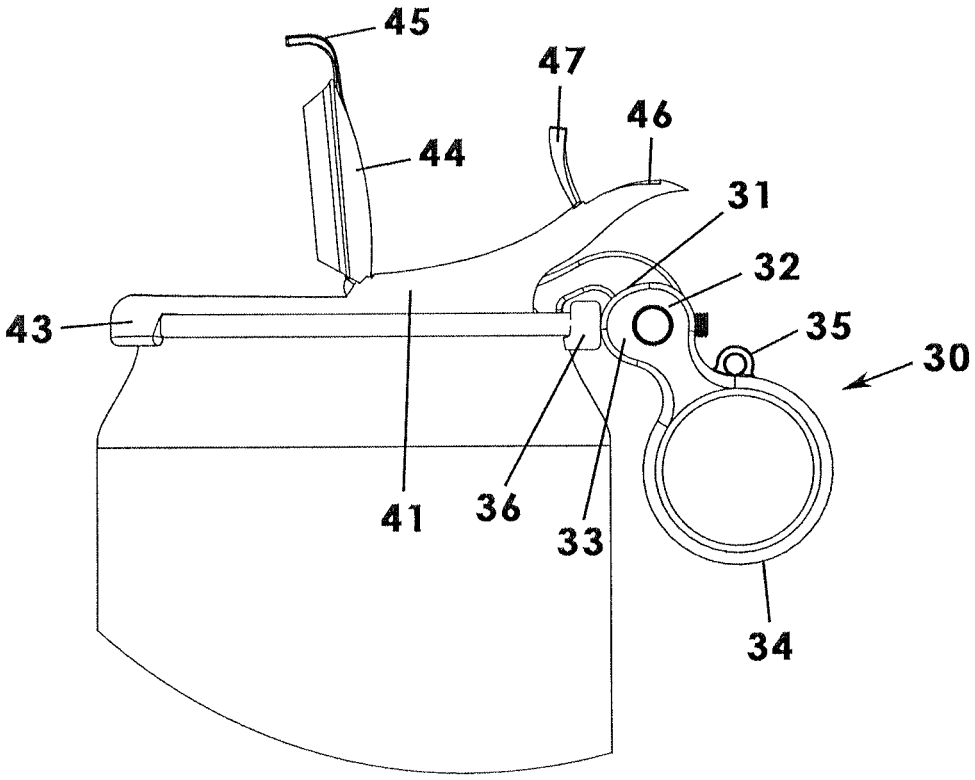
FIG. 7 is a side view of the holding apparatus as in FIG. 4, illustrated with the lid and reservoir cover of a cover assembly in open configurations, respectively.
Figure 8:
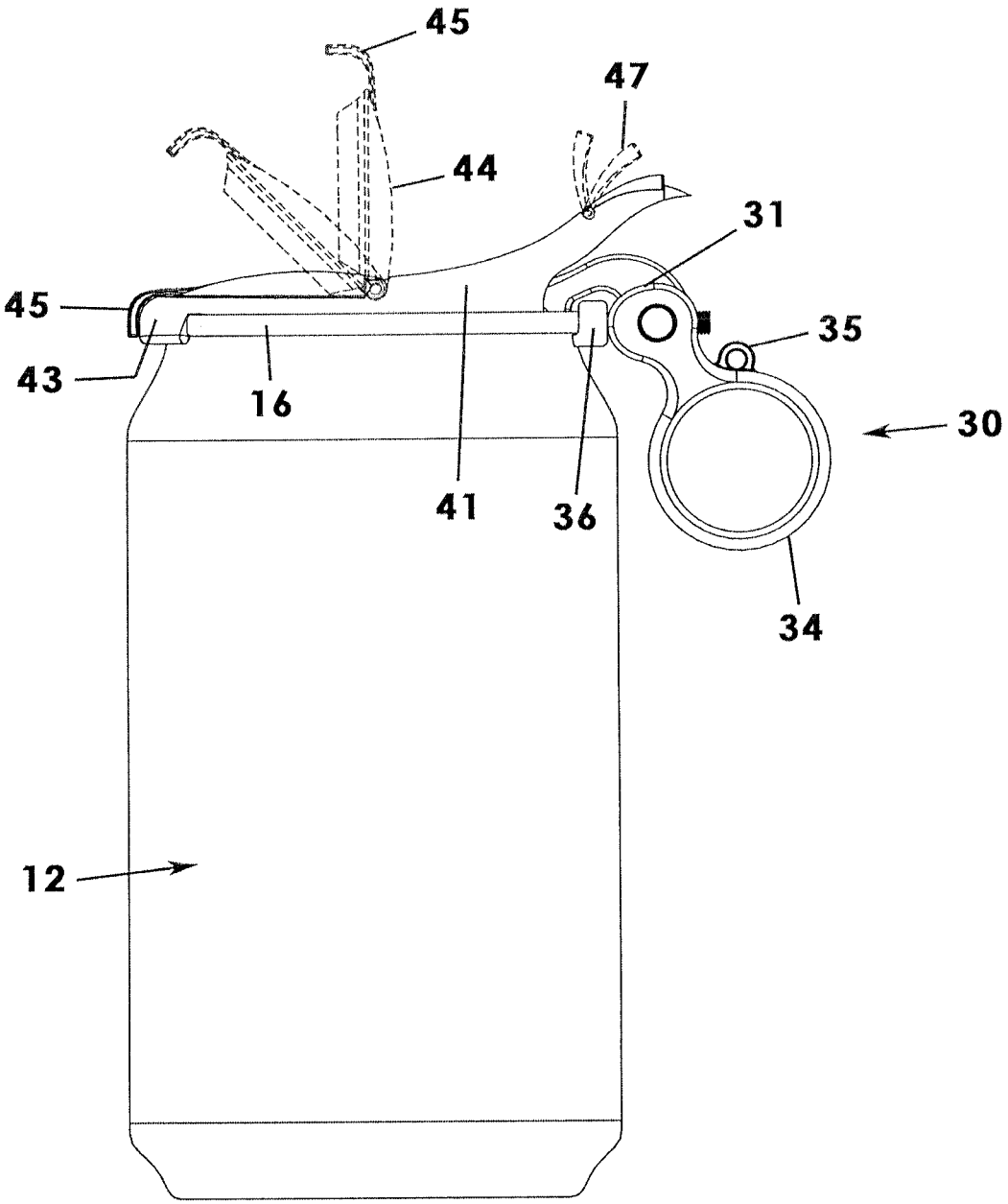
FIG. 8 is a side view of the holding apparatus as in FIGS. 3 and 4, illustrating the lid and reservoir covers moving between the closed and open configurations.

In another aspect, the beverage can holding apparatus 10 includes a cover assembly 40 having a cover base 41 releasably attached to the cam lever 30. The cover base 41 includes a lip portion 43 having a shape configuration complementary to the lip 16 of the beverage can 12 and operable to engage the beverage can lip 16 in a friction fit arrangement. When the lip portion 43 is coupled to the can lip 16, the cover base 41 covers and blocks access to the drink opening 18 of the beverage can 12. More particularly, the cover base 41 includes a lid 44 pivotally coupled to the cover base 41 and that is pivotally movable between a closed configuration blocking access to the drink opening 18 (FIG. 6) and an open configuration allowing access to the drink opening 18 (FIG. 7). In addition, a lid opening flange 45 is coupled to and extends from a front edge of the lid 44 and is operable for enabling a user to manipulate and move the lid 44 between the closed and open configurations, as shown in FIG. 8.

Still further, the cover base 41 includes an identification reservoir 46 that defines an open interior area and an identification cover 47. More particularly, the identification cover 47 is constructed of a transparent material, such as a thin plastic such as Plexiglas® and is pivotally movable between a closed configuration blocking access to the interior area and an open configuration allowing access into the interior area. It will be appreciated that a user may mark his name on a piece of paper or simply insert a colored paper or other distinctive artifact into the interior area and the identification cover 47 may be closed. In other words, the identification reservoir 46 allows each of a plurality of beverage can holding apparatuses to be personalized so that a user always picks up the correct beverage can 12 and they are not confused.

Figure 10:
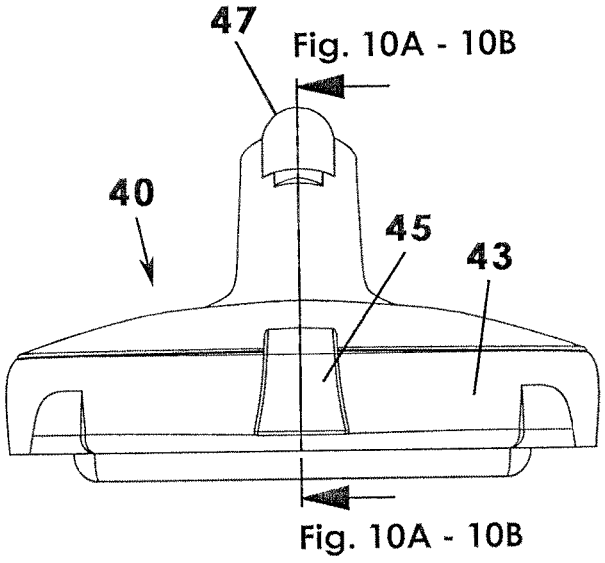
FIG. 10 is a front view of a cover assembly removed from a remainder of the holding apparatus according to the present invention.
Figure 10A:
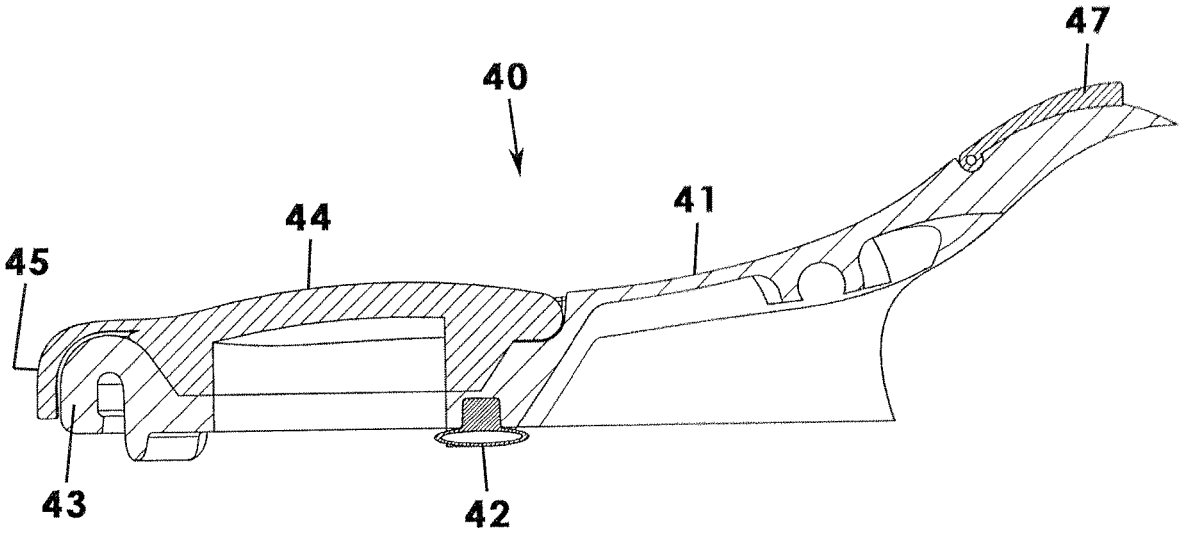
FIG. 10A is a sectional view taken along line 10A-10A of FIG. 10.
Figure 10B:
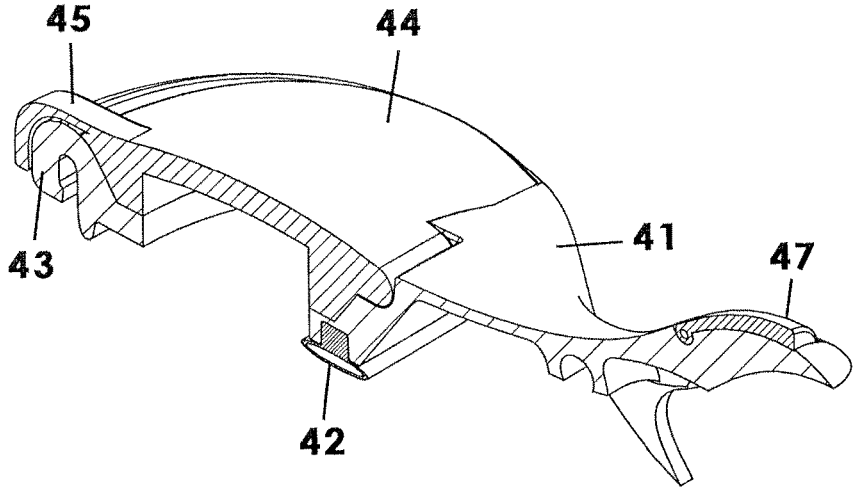
FIG. 10B is a sectional view from another angle taken along line 10B-10B of FIG. 10.

In addition, a bottom surface of the cover base 41 defines a recess 42 that is shaped to selectively receive and mate with the knob 27 of the cam lever 20 described above (FIGS. 10A and 10B). The knob 27 and recess 42 are operable to attach the cam lever 20 and cover base 41 in a light friction fit connection that is selectively separated by a gentle pulling force of a user.

In use, the beverage can holding apparatus 10 may be "locked" onto the top of a beverage can, e.g. soda, beer, or the like, so that a user is able to carry the can around without spilling the beverage. First the hook end 21 of the cam lever 20 may be hooked onto the pull tab 14 of a beverage can 12 and the clamp 36 is positioned proximate the lip 16 of the beverage can 12. Then, as described above, the cam handle 30 may be pulled downwardly so that the clamp 36 is tightened against the lip 16 of the beverage can 12 in a cam action (FIG. 5). Once deployed or locked down, a user's ability to pick up the can using the finger opening of the cam handle 30 is enhanced as described previously. In addition, the user may open the identification cover 47 and a colored paper or an artifact having other distinctive indicia may be inserted into the interior area so as to personalize the apparatus.

It is understood that while certain forms of this invention have been illustrated and described, it is not limited thereto except insofar as such limitations are included in the following claims and allowable functional equivalents thereof.

The invention claimed is:

1. A beverage can holding apparatus for assisting a person holding a beverage can of a type having a lip, a pull tab, and a drink opening, said beverage can holding apparatus, comprising:

a cam lever having a hook end operable for engaging the pull tab and a clamping end opposite said hook end, said clamping end defining a bore;

a pin positioned in said bore and defining an axis of rotation for pivotal movement of said cam lever about said pin;

a cam handle member that includes an actuator end rotatably coupled to said pin and a ring opposite said actuator end, said actuator end including a narrow portion having a first radius relative to said pin and an expanded portion having a second radius relative to said pin and larger than said first radius;

a clamp operably coupled to said cam handle member via a linkage and having an inner surface operable to engage an outer surface of the lip of the beverage can when actuated;

wherein said cam handle member is rotatably movable about said pin between a stowed configuration in which said expanded portion of actuator end is displaced from said clamp and a deployed configuration at which said expanded portion of said actuator member bears against and urges said clamp to engage an outside surface of the lip of the beverage can.

2. The beverage can holding apparatus as in claim 1, wherein:

said pin has a cylindrical configuration that defines a throughbore;

said clamp defines a channel aligned with said throughbore;

said clamping end of said cam lever defines a longitudinal bore aligned with said throughbore and said channel;

said beverage can holding apparatus comprising a guide pin having a cylindrical configuration and extending through said throughbore and said channel.

3. The beverage can holding apparatus as in claim 2, wherein said linkage comprises said guide pin, said throughbore, said channel, and said longitudinal bore.

4. The beverage can holding apparatus as in claim 1, wherein:

said cam lever includes a lip flange intermediate said hook end and said clamping end, said lip flange being configured and operable for engaging an inner surface of the lip of the beverage can;

said clamp is positioned intermediate said lip flange and said clamping end of said cam lever;

said lip flange and said inner surface of said clamp tighten about the lip of the beverage can when said cam handle member is moved to said deployed configuration.

5. The beverage can holding apparatus as in claim 1, wherein:

said actuator end of said cam handle member includes a pair of forks spaced apart from one another, each fork being operably coupled to and axially rotatable about said pin;

said pair of forks, together, defines a notch and said actuator end of said cam lever is positioned in said notch and operably coupled to said pin.

6. The beverage can holding apparatus as in claim 1, wherein said ring has a circular configuration and defines a void operable to receive a person's finger.

7. The beverage can holding apparatus as in claim 1, further comprising a keychain ring coupled to said cam handle member.

8. The beverage can holding apparatus as in claim 1, further comprising a cover assembly that includes a cover base that is removably coupled to the cam lever, said cover base having a lip portion operable for engaging the lip of the beverage can and covering the drink opening of the beverage can.

9. The beverage can holding apparatus as in claim 8, wherein said cover assembly includes a lid pivotally coupled to said cover base and pivotally movable between a closed configuration blocking access to the drink opening of the beverage can and an open configuration allowing access to the drink opening of the beverage can.

10. The beverage can holding apparatus as in claim 8, wherein said cover base includes an identification reservoir defining an open area and an identification cover pivotally movable between a closed configuration blocking access to said interior area and an open configuration allowing access to said interior area.

11. The beverage can holding apparatus as in claim 9, wherein said cover assembly includes a lid opening flange extending from a front edge of said lid and operable for manually moving said lid between said open and closed configuration.

12. The beverage can holding apparatus as in claim 10, wherein said identification cover is a transparent window.

13. The beverage can holding apparatus as in claim 8, wherein:

said cam lever includes a mounting knob extending upwardly;

said cover base defining a recess having a configuration operable to receive said mounting knob in a friction fit arrangement such that said cover assembly is releasably coupled to said cam lever.

14. A beverage can holding apparatus for assisting a person holding a beverage can of a type having a lip, a pull tab, and a drink opening, said beverage can holding apparatus, comprising:

a cam lever having a hook end operable for engaging the pull tab and a clamping end opposite said hook end, said clamping end defining a bore;

a pin positioned in said bore and defining an axis of rotation for pivotal movement of said cam lever about said pin;

a cam handle member that includes an actuator end rotatably coupled to said pin and a ring opposite said actuator end, said actuator end including a narrow portion having a first radius relative to said pin and an expanded portion having a second radius relative to said pin and larger than said first radius;

a clamp operably coupled to said cam handle member via a linkage and having an inner surface operable to engage an outer surface of the lip of the beverage can when actuated;

wherein said cam handle member is rotatably movable about said pin between a stowed configuration in which said expanded portion of actuator end is displaced from said clamp and a deployed configuration at which said expanded portion of said actuator member bears against and urges said clamp to engage an outside surface of the lip of the beverage can;

a cover assembly that includes a cover base that is removably coupled to said cam lever, said cover base having a lip portion operable for engaging the lip of the beverage can and covering the drink opening of the beverage can.

15. The beverage can holding apparatus as in claim 14, wherein said cover assembly includes a lid pivotally coupled to said cover base and pivotally movable between a closed configuration blocking access to the drink opening of the beverage can and an open configuration allowing access to the drink opening of the beverage can.

16. The beverage can holding apparatus as in claim 14, wherein:

said cover base includes an identification reservoir defining an open area and an identification cover pivotally movable between a closed configuration blocking access to said interior area and an open configuration allowing access to said interior area said identification cover is a transparent window.

17. The beverage can holding apparatus as in claim 14, wherein:

said cam lever includes a mounting knob extending upwardly;

said cover base defining a recess having a configuration operable to receive said mounting knob in a friction fit arrangement such that said cover assembly is releasably coupled to said cam lever.

18. The beverage can holding apparatus as in claim 14, wherein:

said pin has a cylindrical configuration that defines a throughbore;

said clamp defines a channel aligned with said throughbore;

said clamping end of said cam lever defines a longitudinal bore aligned with said throughbore and said channel;

said beverage can holding apparatus comprising a guide pin having a cylindrical configuration and extending through said throughbore and said channel.

19. The beverage can holding apparatus as in claim 14, wherein:

said cam lever includes a lip flange intermediate said hook end and said clamping end, said lip flange being configured and operable for engaging an inner surface of the lip of the beverage can;

said clamp is positioned intermediate said lip flange and said clamping end of said cam lever;

said lip flange and said inner surface of said clamp tighten about the lip of the beverage can when said cam handle member is moved to said deployed configuration.

20. The beverage can holding apparatus as in claim 14, wherein:

said actuator end of said cam handle member includes a pair of forks spaced apart from one another, each fork being operably coupled to and axially rotatable about said pin;

said pair of forks, together, define a notch and said actuator end of said cam lever is positioned in said notch and operably coupled to said pin.

* * * * *